US010613461B2

(12) United States Patent
Ando et al.

(10) Patent No.: US 10,613,461 B2
(45) Date of Patent: Apr. 7, 2020

(54) IMAGE FORMING APPARATUS

(71) Applicant: KYOCERA Document Solutions Inc., Osaka (JP)

(72) Inventors: Satoshi Ando, Osaka (JP); Yasuhiro Miyake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/390,438

(22) Filed: Apr. 22, 2019

(65) Prior Publication Data

US 2019/0324393 A1 Oct. 24, 2019

(30) Foreign Application Priority Data

Apr. 24, 2018 (JP) ..... 2018-083058

(51) Int. Cl.
*G03G 15/00* (2006.01)

(52) U.S. Cl.
CPC ..... *G03G 15/5016* (2013.01); *G03G 15/5004* (2013.01)

(58) Field of Classification Search
CPC ..... G03G 15/5004; G03G 15/5016
See application file for complete search history.

(56) References Cited

U.S. PATENT DOCUMENTS

2011/0314951 A1* 12/2011 Uchida ..... G03G 15/5016 74/491
2012/0243042 A1* 9/2012 Uchida ..... G06F 1/1624 358/1.15
2017/0272593 A1* 9/2017 Kamiya ..... G03G 15/5016
2018/0013905 A1* 1/2018 Kuroki ..... G03G 15/50
2018/0246463 A1* 8/2018 Ichikawa ..... G03G 15/5016

FOREIGN PATENT DOCUMENTS

JP 05165265 A * 7/1993
JP 2005292372 A * 10/2005
JP 2006-013584 A 1/2006

* cited by examiner

*Primary Examiner* — Carla J Therrien
(74) *Attorney, Agent, or Firm* — Studebaker & Brackett PC

(57) ABSTRACT

An image forming apparatus includes an image forming section, a casing, an operation panel, a locking mechanism, and a cutoff section. The image forming section forms an image on paper. The casing houses the image forming section. The operation panel is movable toward at least one side of the casing. The locking mechanism restricts movement of the operation panel. The cutoff section cuts off supply of electricity to the image forming section. The cutoff section cuts off the supply of electricity to the image forming section while the locking mechanism restricts the movement of the operation panel.

6 Claims, 6 Drawing Sheets

IMAGE FORMING APPARATUS

INCORPORATION BY REFERENCE

The present application claims priority under 35 U.S.C. § 119 to Japanese Patent Application No. 2018-083058, filed on Apr. 24, 2018. The contents of this application are incorporated herein by reference in their entirety.

BACKGROUND

The present disclosure relates to an image forming apparatus.

An image forming apparatus includes an operation panel, a person detection controller, and an operation panel moving section. The person detection controller detects a user in the vicinity of the image forming apparatus. The operation panel moving section changes the orientation of the operation panel. Specifically, the operation panel moving section changes the orientation of the operation panel such that an operation surface of the operation panel is oriented toward the user detected by the person detecting controller.

SUMMARY

An image forming apparatus according to an aspect of the present disclosure includes an image forming section, a casing, an operation panel, a locking mechanism, and a cutoff section. The image forming section forms an image on a recording medium. The casing houses the image forming section. The operation panel is movable toward at least one side of the casing. The locking mechanism restricts movement of the operation panel. The cutoff section cuts off supply of electricity to the image forming section. The cutoff section cuts off the supply of electricity to the image forming section while the locking mechanism restricts the movement of the operation panel.

BRIEF DESCRIPTION OF THE DRAWINGS

FIG. 2A is a diagram illustrating a state in which the locking mechanism restricts movement of the operation panel. FIG. 2B is a diagram illustrating a state in which the cutoff section does not cut off supply of electricity.

FIG. 3A is an internal configuration diagram illustrating the state in which the locking mechanism restricts movement of the operation panel. FIG. 3B is an internal configuration diagram illustrating a state in which the movement of the operation panel is not restricted by the locking mechanism.

FIG. 4A is a cross-sectional view taken along a line IVA-IVA illustrating the state in which the locking mechanism restricts movement of the operation panel.

FIG. 4B is a cross-sectional view taken along a line IVB-IVB illustrating the state in which the movement of the operation panel is not restricted by the locking mechanism.

FIG. 5A is a front view of a state in which the cutoff section cuts off the supply of electricity. FIG. 5B is a front view of the state in which the cutoff section does not cut off the supply of electricity.

DETAILED DESCRIPTION

Figure 1:
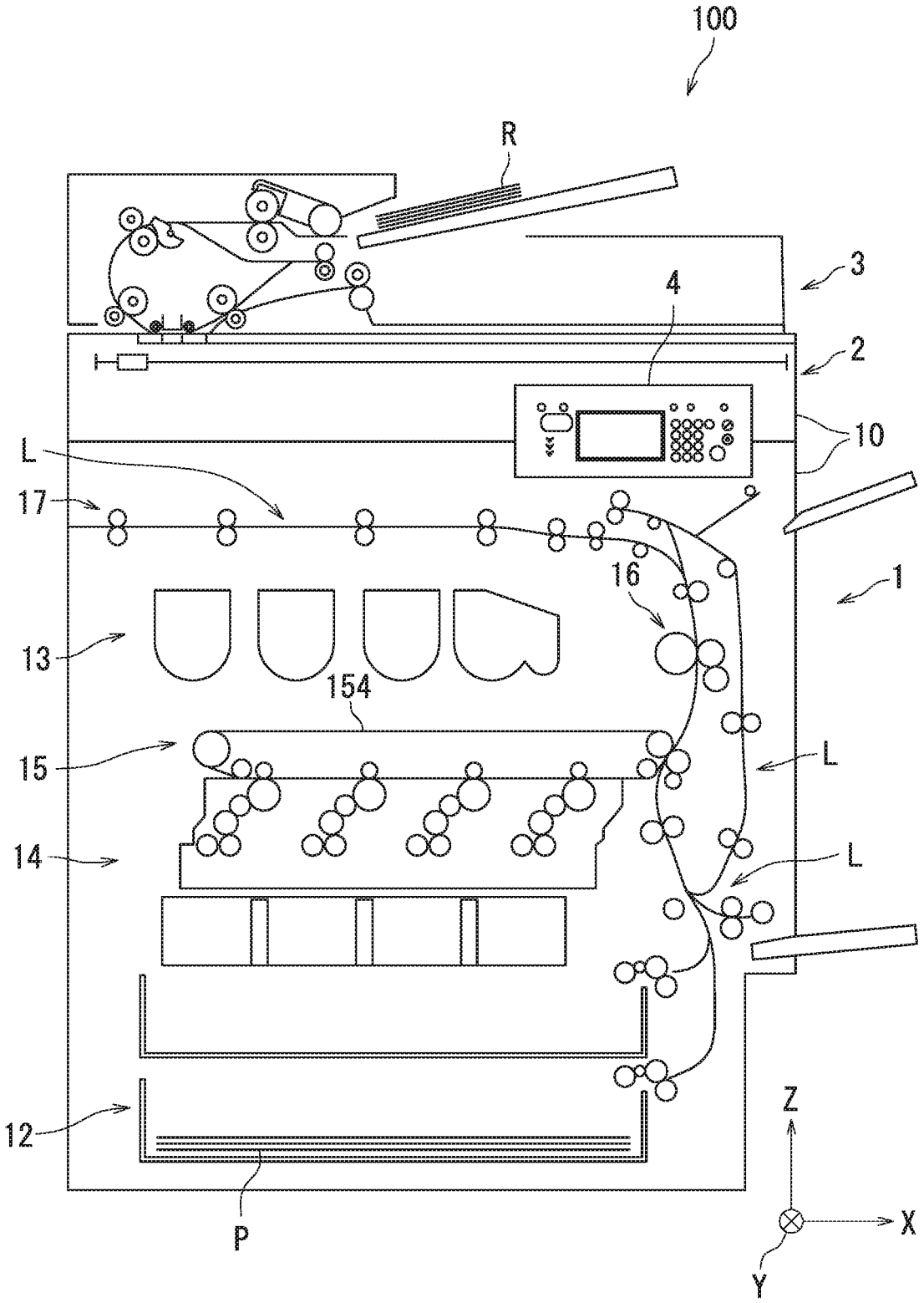
FIG. 1 is a diagram illustrating an example of a configuration of an image forming apparatus according to an embodiment of the present disclosure.

The following describes an embodiment of the present disclosure with reference to FIGS. 1 to 6. Note that elements that are the same or equivalent are labelled with the same reference signs in the drawings and description thereof is not repeated.

The following first describes a configuration of an image forming apparatus 100 according to the embodiment of the present disclosure with reference to FIG. 1. FIG. 1 is a diagram illustrating an example of the configuration of the image forming apparatus 100. The image forming apparatus 100 is a color multifunction peripheral.

As illustrated in FIG. 1, the image forming apparatus 100 includes an image forming unit 1, an image reading unit 2, a document conveyance unit 3, an operation panel 4, and a casing 10. The image forming unit 1 forms an image on paper P. The paper P is one example of a recording medium. The image reading unit 2 reads an image formed on a document R and generates image information. The document conveyance unit 3 conveys the document R to the image reading unit 2. The operation panel 4 receives a user operation.

FIG. 1 shows mutually orthogonal X, Y, and Z axes. The X and Y axes are parallel to a horizontal plane. The Z axis is parallel to a vertical direction. In the following description, a positive direction of the Y axis may be referred to as backward, and a negative direction of the Y axis may be referred to as forward. A positive direction of the X axis may be referred to as right, and a negative direction of the X axis may be referred to as left. A positive direction of the Z axis may be referred to as up, and a negative direction of the Z axis may be referred to as down.

The image forming unit 1 includes a feeding section 12, a conveyance section L, a toner supply section 13, an image forming section 14, a fixing section 16, and an ejection section 17. The image forming section 14 includes a transfer section 15. The casing 10 houses the feeding section 12, the conveyance section L, the toner supply section 13, the image forming section 14, the fixing section 16, and the ejection section 17.

The feeding section 12 feeds the paper P to the conveyance section L. The conveyance section L conveys the paper P to the ejection section 17 by way of the transfer section 15 and the fixing section 16.

A toner container is attached to the toner supply section 13. The toner container supplies toner to the image forming section 14. The image forming section 14 forms an image on the paper P.

The transfer section 15 includes an intermediate transfer belt 154. The image forming section 14 transfers cyan, magenta, yellow, and black toner images onto the intermediate transfer belt 154. The multiple colored toner images are superimposed on the intermediate transfer belt 154, thus forming a toner image on the intermediate transfer belt 154. The transfer section 15 transfers the toner image formed on the intermediate transfer belt 154 onto the paper P. As a result, an image is formed on the paper P.

The fixing section 16 applies heat and pressure to the paper P to fix the image formed on the paper P to the paper P. The ejection section 17 ejects the paper P out of the image forming apparatus 100.

Figure 2A:
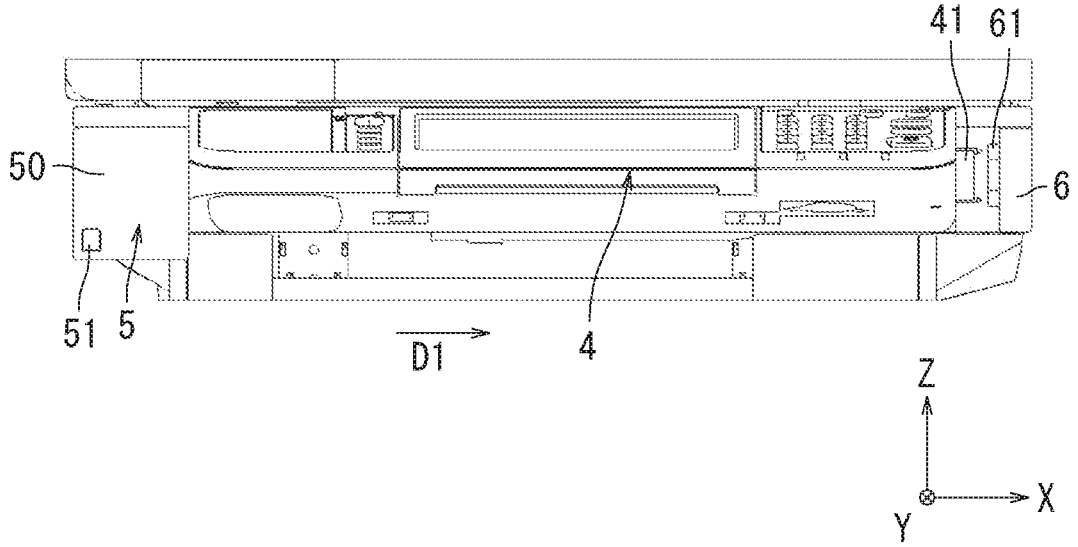
FIGS. 2A and 2B are front views of an example of an arrangement of an operation panel, a locking mechanism, and a cutoff section according to the embodiment of the present disclosure.
Figure 2B:
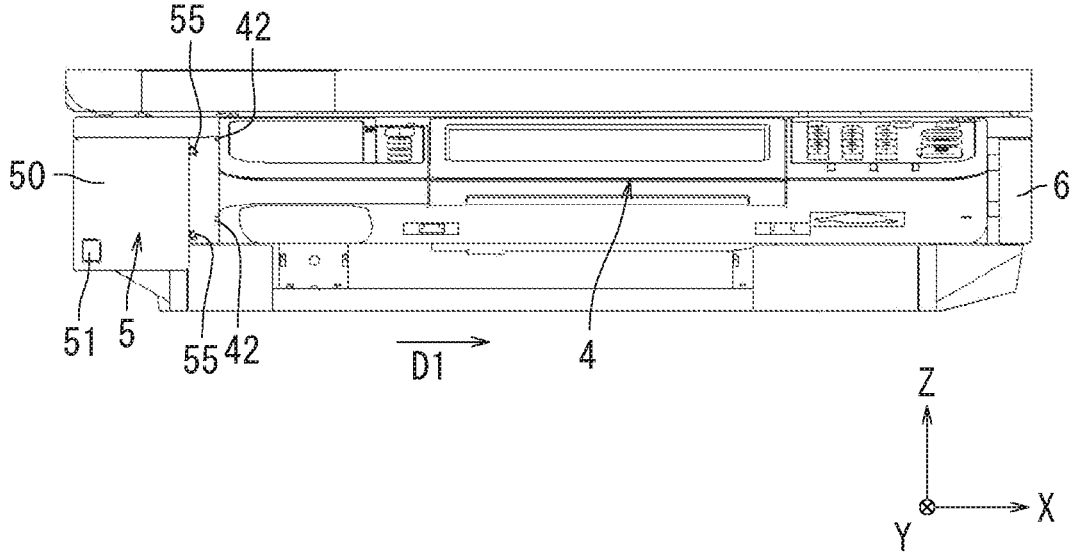

The following describes an arrangement of the operation panel 4, a locking mechanism 5, and a cutoff section 6 according to the embodiment of the present disclosure with reference to FIGS. 1, 2A, and 2B. FIGS. 2A and 2B are front views of an example of the arrangement of the operation panel 4, the locking mechanism 5, and the cutoff section 6. FIG. 2A is a diagram illustrating a state in which the locking mechanism 5 restricts movement of the operation panel 4. FIG. 2B is a diagram illustrating a state in which the cutoff section 6 does not cut off supply of electricity.

As illustrated in FIGS. 2A and 2B, the locking mechanism 5 is arranged on the left of the operation panel 4. In other words, the locking mechanism 5 is arranged in the negative direction of the X axis relative to the operation panel 4. The locking mechanism 5 is secured to the casing 10 illustrated in FIG. 1. The cutoff section 6 is arranged to the right of the operation panel 4. In other words, the cutoff section 6 is arranged in the positive direction of the X axis relative to the operation panel 4. That is, the operation panel 4 is arranged between the locking mechanism 5 and the cutoff section 6. The cutoff section 6 is secured to the casing 10 illustrated in FIG. 1.

As illustrated in FIG. 2A, the operation panel 4 is movable in a first direction D1. In other words, the operation panel 4 is movable toward at least one side of the casing 10 according to the present embodiment. According to the present embodiment, the first direction D1 is the positive direction of the X axis. The locking mechanism 5 is arranged in a direction opposite to the first direction D1 relative to the operation panel 4. The cutoff section 6 is arranged in the first direction D1 relative to the operation panel 4.

The locking mechanism 5 restricts movement of the operation panel 4 in the first direction D1. As illustrated in FIG. 2B, the operation panel 4 includes two second engaging members 42. The locking mechanism 5 includes a locking mechanism main body 50, a push button 51, and two first engaging members 55.

The locking mechanism main body 50 has the shape of a flat rectangular plate. The push button 51 is arranged on a lower right end of the locking mechanism main body 50. In other words, the push button 51 is arranged on an end portion of the locking mechanism main body 50 in the negative direction of the X axis and the negative direction of the Z axis.

The user pushes the push button 51 to release the movement of the operation panel 4 from restriction by the locking mechanism 5. The user pushes the push button 51 in the positive direction of the Y axis.

Each of the two first engaging members 55 is arranged on the right of the locking mechanism main body 50. Each of the two first engaging members 55 protrudes rightward from the locking mechanism main body 50. Each first engaging member 55 engages with a corresponding one of the second engaging members 42.

The movement of the operation panel 4 is restricted by the first engaging members 55 engaging the corresponding second engaging members 42. In other words, the locking mechanism 5 restricts the movement of the operation panel 4 by engaging the first engaging members 55 with the corresponding second engaging members 42. A configuration of the locking mechanism 5 is described later in detail with reference to FIGS. 3A to 4B.

Each of the two second engaging members 42 is arranged on the left of the operation panel 4. Each of the two second engaging members 42 protrudes leftward from the operation panel 4. Each second engaging member 42 engages with a corresponding one of the first engaging members 55.

As illustrated in FIG. 2A, the operation panel 4 further includes a first connector 41. The cutoff section 6 includes a second connector 61. The cutoff section 6 cuts off the supply of electricity to the image forming section 14 illustrated in FIG. 1.

The first connector 41 is arranged on the right of the operation panel 4. The first connector 41 protrudes rightward from the operation panel 4. The second connector 61 is arranged on the left of the cutoff section 6. The second connector 61 protrudes leftward from the cutoff section 6. In a state in which the locking mechanism 5 restricts the movement of the operation panel 4 in the first direction D1, the first connector 41 and the second connector 61 are separated from each other. That is, the cutoff section 6 cuts off the supply of electricity to the image forming section 14 illustrated in FIG. 1.

As illustrated in FIG. 2B, the first connector 41 and the second connector 61 are connected to each other when the operation panel 4 is moved in the first direction D1 relative to the casing 10 as illustrated in FIG. 1. The cutoff section 6 then stops cutting off the supply of electricity to the image forming section 14 illustrated in FIG. 1. That is, the cutoff section 6 allows the supply of electricity to the image forming section 14. The first connector 41 and the second connector 61 are "drawer connectors", for example.

As described above with reference to FIGS. 1, 2A, and 2B, the cutoff section 6 cuts off the supply of electricity to the image forming section 14 while the locking mechanism 5 restricts the movement of the operation panel 4. Therefore, the supply of electricity to the image forming section 14 can be cut off even when a main switch is mistakenly left on. Accordingly, user convenience can be increased.

The locking mechanism 5 also restricts the movement of the operation panel 4 in the first direction D1. The cutoff section 6 allows the supply of electricity to the image forming section 14 when the operation panel 4 has moved in the first direction D1 relative to the casing 10. Therefore, the supply of electricity to the image forming section 14 can be allowed in a simple configuration. Accordingly, the user convenience can be increased.

Furthermore, the locking mechanism 5 is arranged in the direction opposite to the first direction D1 relative to the operation panel 4. The cutoff section 6 is arranged in the first direction D1 relative to the operation panel 4. Accordingly, the locking mechanism 5, the operation panel 4, and the cutoff section 6 can be arranged compactly.

Moreover, the operation panel 4 includes the first connector 41. The cutoff section 6 includes the second connector 61. The cutoff section 6 allows the supply of electricity to the image forming section 14 when the first connector 41 is connected to the second connector 61. Accordingly, the supply of electricity to the image forming section 14 can be allowed in a simple configuration.

Furthermore, the locking mechanism 5 includes the two first engaging members 55. The operation panel 4 includes the two second engaging members 42. The locking mechanism 5 restricts the movement of the operation panel 4 through the two first engaging members 55 engaging with the corresponding second engaging members 42. Accordingly, the movement of the operation panel 4 can be restricted in a simple configuration.

Note that although the first direction D1 is the positive direction of the X axis according to the embodiment of the present disclosure, the present disclosure is not limited as such. The first direction D1 may be any direction. For example, the first direction D1 may be the positive direction of the Y axis. For another example, the first direction D1 may be the positive direction of the Z axis. In this case, the operation panel 4 is urged in the direction opposite to the first direction D1 by receiving gravitational force. Accordingly, the supply of electricity to the image forming section 14 can be cut off even when for example the locking mechanism 5 does not restrict the movement of the operation panel 4.

Figure 3A:
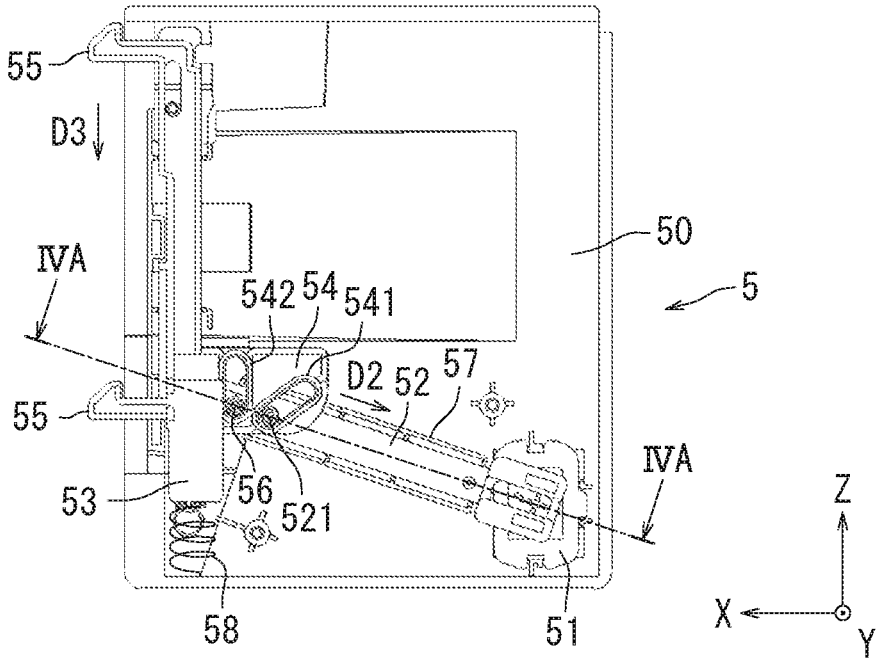
FIGS. 3A and 3B are internal configuration diagrams illustrating an example of a configuration of the locking mechanism according to the embodiment of the present disclosure.
Figure 3B:
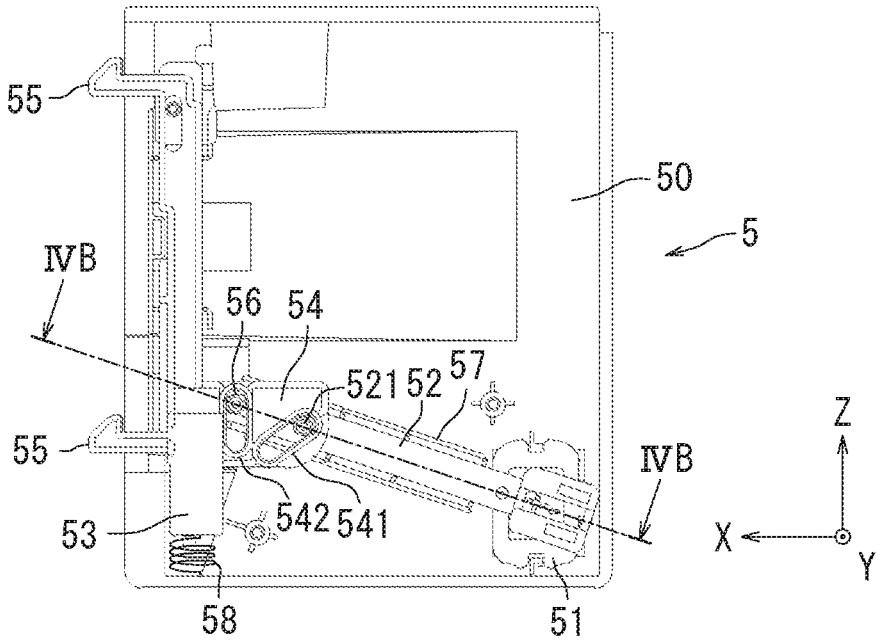
Figure 4A:
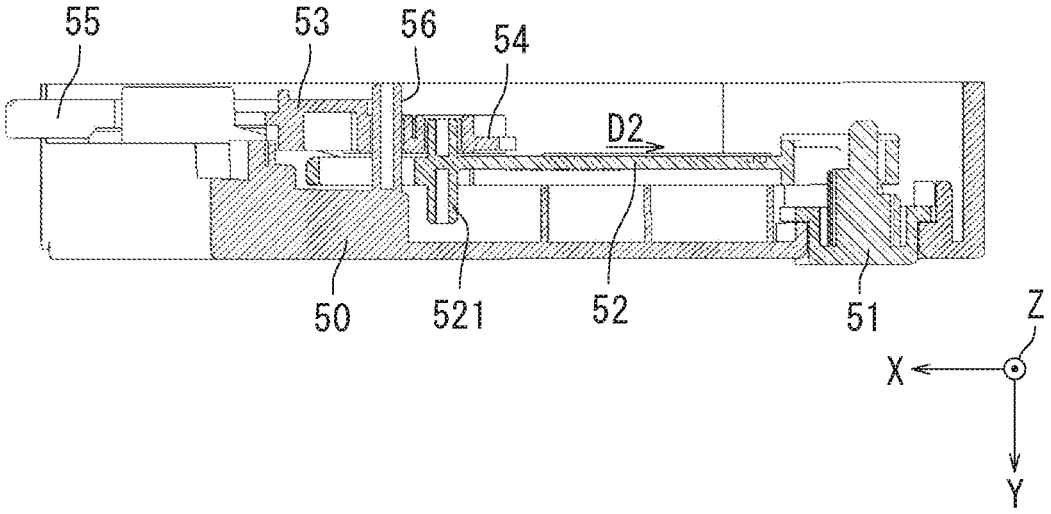
FIGS. 4A and 4B are cross-sectional views illustrating an example of the configuration of the locking mechanism according to the embodiment of the present disclosure.
Figure 4B:
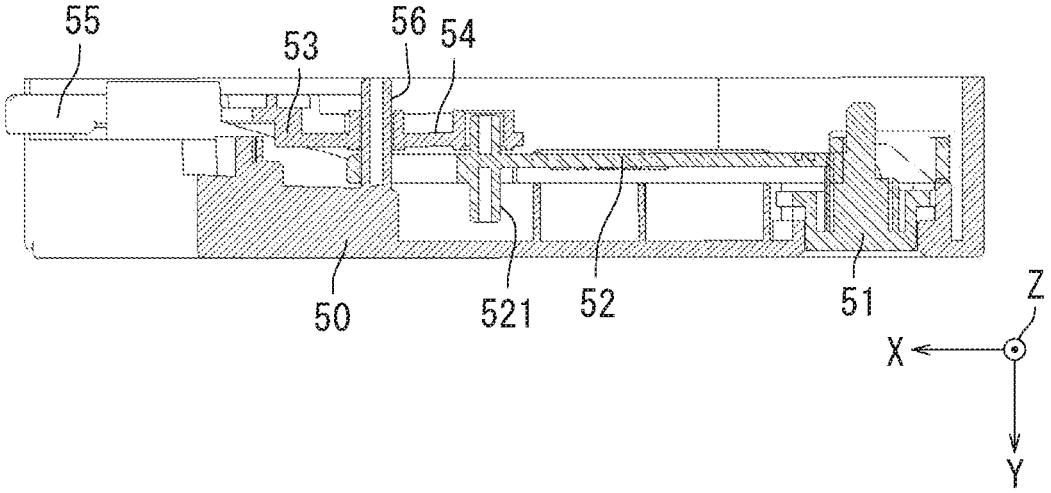

The following describes the configuration of the locking mechanism 5 according to the embodiment of the present disclosure with reference to FIGS. 2A to 4B. FIGS. 3A and 3B are internal configuration diagrams illustrating an example of the configuration of the locking mechanism 5. FIG. 3A is an internal configuration diagram illustrating the state in which the locking mechanism 5 restricts the movement of the operation panel 4. In detail, FIG. 3A is a diagram in which the locking mechanism 5 is viewed from behind. FIG. 3B is an internal configuration diagram illustrating a state in which the movement of the operation panel 4 is not restricted by the locking mechanism 5. In detail, FIG. 3B is a diagram in which the locking mechanism 5 is viewed from behind. FIGS. 4A and 4B are cross-sectional views of the example of the configuration of the locking mechanism 5.

As illustrated in FIGS. 3A and 3B, the locking mechanism 5 further includes a first moving member 52. The first moving member 52 moves in a second direction D2 when the push button 51 is pushed. The second direction D2 is a direction toward the push button 51 from a plate-shaped member 54. The first moving member 52 has a first projection 521. The first projection 521 is arranged on an end portion of the first moving member 52 away from the push button 51. The first projection 521 is integrated with the first moving member 52. The first projection 521 stands from the first moving member 52. Specifically, the first projection 521 protrudes in the positive direction of the Y axis from the first moving member 52. The locking mechanism 5 further includes a second moving member 53, the plate-shaped member 54, a second projection 56, a restricting member 57, and a spring 58.

The second moving member 53 moves in a third direction D3 when the first moving member 52 moves in the second direction D2. The third direction D3 is the negative direction of the Z axis. The third direction D3 is a downward direction in FIGS. 3A and 3B. The second moving member 53 is integrated with the two first engaging members 55. Therefore, when the second moving member 53 moves in the third direction D3, each first engaging member 55 is disengaged from the corresponding second engaging member 42 (refer to FIGS. 2A and 2B).

The plate-shaped member 54 is integrated with the second moving member 53. When the first moving member 52 moves in the second direction D2, the plate-shaped member 54 moves the second moving member 53 in the third direction D3. The plate-shaped member 54 has a first long hole 541 and a second long hole 542. The first long hole 541 extends in a diagonally upward direction. In detail, the first long hole 541 extends upward to the left. That is, the first long hole 541 extends from a point in the positive direction of the X axis and the negative direction in the Z axis to a point in the negative direction of the X axis and the positive direction in the Z axis. In other words, the first long hole 541 extends in a direction 45 degrees away from the negative direction of the X axis on an X-Z plane. The first projection 521 is inserted through the first long hole 541. That is, the movement direction of the first projection 521 is restricted by the extending direction of the first long hole 541. In the state in which the locking mechanism 5 restricts the movement of the operation panel 4 as illustrated in FIG. 3A, the first projection 521 is positioned at a lower left end of the first long hole 541.

The second long hole 542 extends in an up-and-down direction. That is, the second long hole 542 extends along the Z axis. The second projection 56 is inserted through the second long hole 542. The second projection 56 stands from the locking mechanism main body 50. According to the present embodiment, the second projection 56 is integrated with the locking mechanism main body 50. The second projection 56 protrudes in the positive direction of the Y axis from the locking mechanism main body 50.

The restricting member 57 restricts a movement direction of the first moving member 52. Specifically, the restricting member 57 guides the first moving member 52 so as to move in the second direction D2. That is, the movement direction of the first moving member 52 is restricted to the second direction D2 or a direction opposite to the second direction D2 by the restricting member 57.

The spring 58 urges the second moving member 53 upward. That is, the spring 58 urges each first engaging member 55 in a direction in which the first engaging member 55 engages with the corresponding second engaging member 42. The spring 58 is equivalent to an example of an "urging member".

The following describes operation of the locking mechanism 5. When the push button 51 is pushed and the first moving member 52 moves in the second direction D2, the first projection 521 moves together with the first moving member 52.

Specifically as illustrated in FIG. 3B, the first projection 521 moves from a lower left end of the first long hole 541 to an upper right end of the first long hole 541. The movement of the first projection 521 from the lower left end of the first long hole 541 to the upper right end of the first long hole 541 is described with reference to FIGS. 4A and 4B.

FIG. 4A is a cross-sectional view taken along a line IVA-IVA illustrating the state in which the locking mechanism 5 restricts the movement of the operation panel 4. FIG. 4B is a cross-sectional view taken along a line IVB-IVB illustrating the state in which the movement of the operation panel 4 is not restricted by the locking mechanism 5.

As illustrated in FIGS. 4A and 4B, the first moving member 52 moves in the second direction D2. That is, the first moving member 52 moves left when the push button 51 is pushed. Upon the first moving member 52 moving in the second direction D2, the distance between the first projection 521 and the second projection 56 increases. Specifically, the first projection 521 moves in the second direction D2 relative to the second projection 56.

As described with reference to FIGS. 3A and 3B, the first long hole 541 extends upward to the left. Accordingly, as illustrated in FIG. 3B, the first projection 521 moves the plate-shaped member 54 in the third direction D3 through the first long hole 541. The third direction D3 is a downward direction. In other words, the third direction D3 is the negative direction of the Z axis. The plate-shaped member 54, the second moving member 53, and the two first engaging members 55 then move together in the third direction D3. As a result, the two first engaging members 55 are disengaged from the corresponding second engaging members 42 (refer to FIGS. 2A and 2B).

When pushing force from the outside of the push button 51 is not in effect, the second moving member 53 is moved upward by the spring 58. The plate-shaped member 54, the second moving member 53, and the two first engaging members 55 then move together in the direction opposite to the third direction D3. As a result, the two first engaging members 55 engage with the corresponding second engaging members 42.

Upon the plate-shaped member 54 moving upward, the first projection 521 moves from the upper right end of the first long hole 541 to the lower left end of the first long hole 541. As illustrated in FIG. 3A, the first moving member 52 moves in the direction opposite to the second direction D2.

As described above with reference to FIGS. 2A to 4B, the spring 58 urges the two first engaging members 55 in the direction in which the two first engaging members 55 engage with the corresponding second engaging members 42 (direction opposite to the third direction D3). Therefore, a state in which the two first engaging members 55 engage with the corresponding second engaging members 42 is maintained.

Accordingly, the two first engaging members 55 can be prevented from disengaging from the corresponding second engaging members 42 even when the image forming apparatus 100 is shaken.

When the push button 51 is pushed, the locking mechanism 5 releases the engagement of the two first engaging members 55 with the corresponding second engaging members 42. Accordingly, the restriction of the movement of the operation panel 4 can be released in a simple configuration.

Note that although the engagement of the two first engaging members 55 with the corresponding second engaging members 42 is released when the push button 51 is pushed according to the embodiment of the present disclosure, the present disclosure is not limited as such. The locking mechanism 5 need only be able to release the engagement of the two first engaging members 55 with the corresponding second engaging members 42. For example, the locking mechanism 5 may include a sliding member which moves the two first engaging members 55 in the third direction D3. In this case, the engagement of the two first engaging members 55 with the corresponding second engaging members 42 can be released in a simple configuration.

Figure 5A:
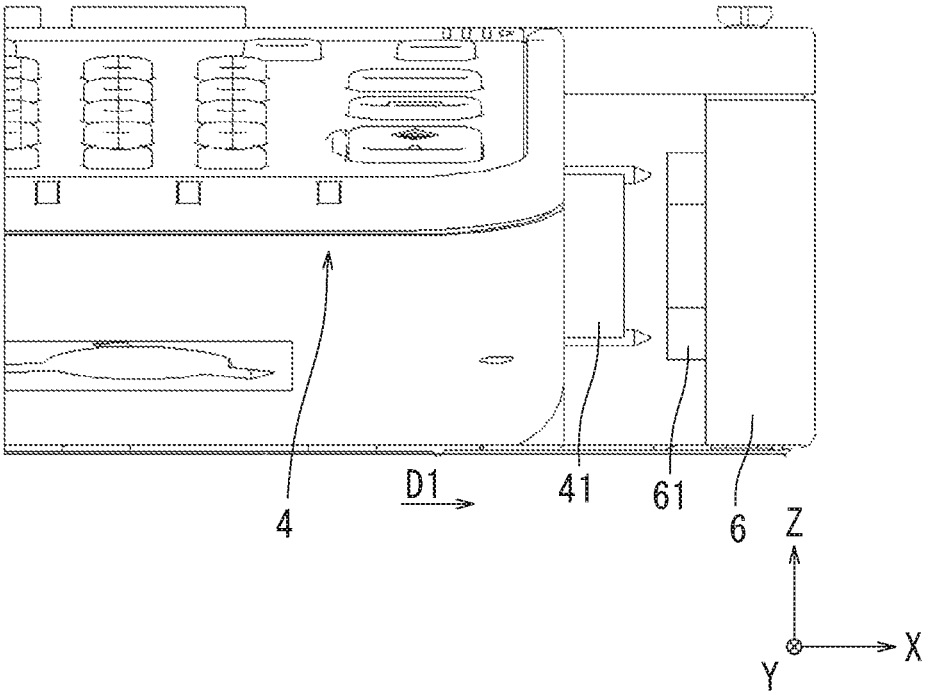
FIGS. 5A and 5B are front views of an example of a configuration of the cutoff section according to the embodiment of the present disclosure.
Figure 5B:
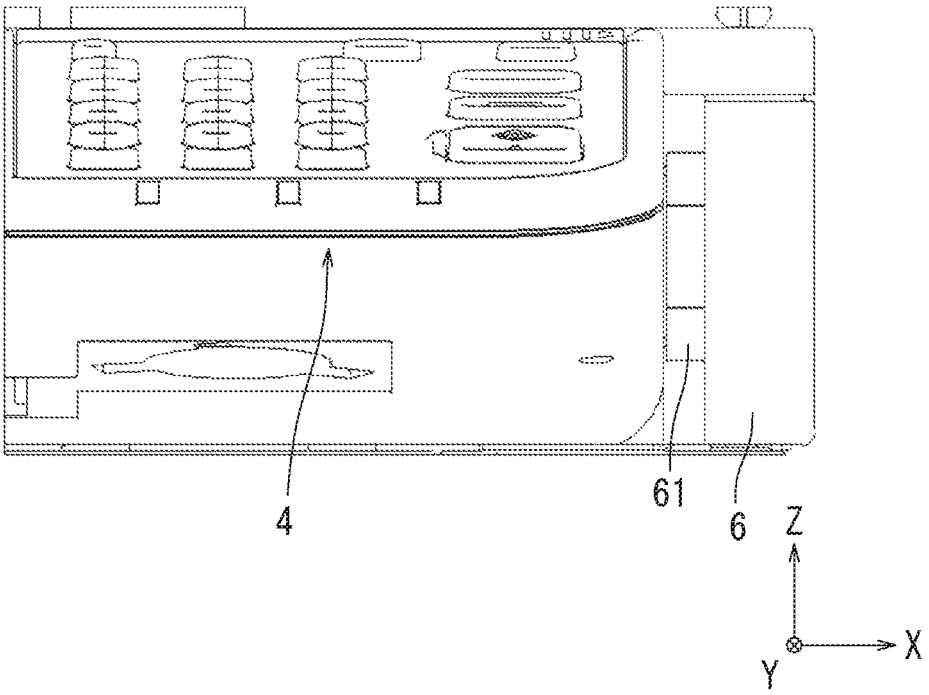

The following further describes a configuration of the cutoff section 6 according to the embodiment of the present disclosure with reference to FIGS. 2A, 2B, 5A, 5B, and 6. FIGS. 5A and 5B are front views of the example of the configuration of the cutoff section 6. FIG. 5A is a front view of a state in which the cutoff section 6 cuts off the supply of electricity. FIG. 5B is a front view of the state in which the cutoff section 6 does not cut off the supply of electricity.

As illustrated in FIG. 5A, the cutoff section 6 cuts off the supply of electricity to the image forming section 14 illustrated in FIG. 1 because the first connector 41 is separated from the second connector 61. When the operation panel 4 is moved in the first direction D1, the first connector 41 and the second connector 61 are connected to each other as illustrated in FIG. 5B. As a result, the cutoff section 6 allows the supply of electricity to the image forming section 14.

Figure 6:
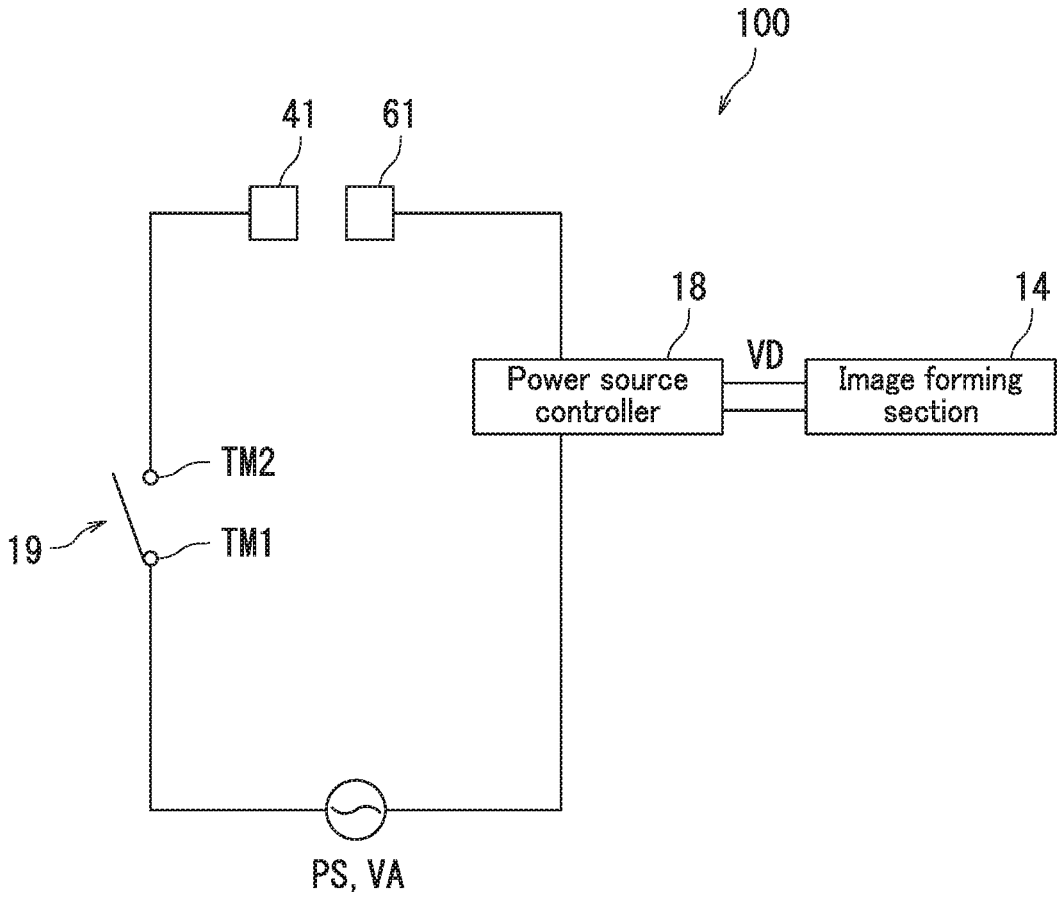
FIG. 6 is a diagram illustrating an example of a configuration in which electricity is supplied from a commercial power source to an image forming section.

FIG. 6 is a diagram illustrating an example of a configuration in which electricity is supplied to the image forming section 14 from a commercial power source PS. As illustrated in FIG. 6, the image forming apparatus 100 further includes a main switch 19 and a power source controller 18.

The main switch 19 turns on and off the supply of electricity to the power source controller 18 from the commercial power source PS. The main switch 19 has a first terminal TM1 and a second terminal TM2. The first terminal TM1 is connected to the commercial power source PS. The second terminal TM2 is connected to the first connector 41. The second connector 61 is connected to the power source controller 18. The power source controller 18 is connected to the commercial power source PS.

The power source controller 18 converts alternating current voltage VA supplied from the commercial power source PS to direct current voltage VD. The power source controller 18 supplies the direct current voltage VD to the image forming section 14.

Even when the main switch 19 is switched on, electricity is not supplied to the power source controller 18 from the commercial power source PS when the first connector 41 and the second connector 61 are not connected to each other. Accordingly, electricity is not supplied to the image forming section 14 from the power source controller 18.

As described above with reference to FIGS. 2A, 2B, 5A, 5B, and 6, the cutoff section 6 cuts off the supply of electricity to the image forming section 14 when the first connector 41 is separated from the second connector 61 according to the embodiment of the present disclosure. Therefore, the supply of electricity to the image forming section 14 can be cut off even when the main switch 19 is mistakenly left on. Accordingly, the user convenience can be increased.

The embodiment of the present disclosure is described above with reference to the drawings. However, the present disclosure is not limited to the above embodiment, and may be implemented in various manners within a scope not departing from the gist of the present disclosure (for example, as described below in (1) to (3)). The drawings schematically illustrate main elements of configuration to facilitate understanding thereof. Aspects of the elements of configuration such as thickness, length, and number thereof illustrated in the drawings may differ in practice for the sake of convenience for drawing preparation. Furthermore, aspects of the elements of configuration such as shape and dimension thereof described in the above embodiment are merely examples and are not particularly limited. The elements of configuration may be variously altered within a scope not substantially departing from the configuration of the present disclosure.

(1) As described with reference to FIGS. 1, 2A, and 2B, the image forming apparatus 100 is a color multifunction peripheral according to the embodiment of the present disclosure. However, the present disclosure is not limited as such. The image forming apparatus need only form an image on the paper P. The image forming apparatus may be a color printer, for example. The image forming apparatus may alternatively be a monochrome copier, for example.

(2) As described with reference to FIGS. 1, 3A, and 3B, the operation panel 4 is arranged between the locking mechanism 5 and the cutoff section 6 according to the embodiment of the present disclosure. However, the present disclosure is not limited as such. The image forming apparatus 100 need only include the operation panel 4, the locking mechanism 5, and the cutoff section 6.

(3) As described with reference to FIGS. 2A to 4B, there are two first engaging members 55 according to the embodiment of the present disclosure. However, the present disclosure is not limited as such. There may be one or three or more first engaging members 55. Also, there are two second engaging members 42 according to the embodiment of the present disclosure, but the present disclosure is not limited as such. There may be one or three or more second engaging members 42.

What is claimed is:

1. An image forming apparatus comprising:

an image forming section configured to form an image on a recording medium;

a casing configured to house the image forming section;

an operation panel which is movable toward at least one side of the casing;

a locking mechanism configured to restrict movement of the operation panel; and a cutoff section configured to cut off supply of electricity to the image forming section, wherein the operation panel includes a first connector, the cutoff section includes a second connector, the cutoff section allows the supply of the electricity to the image forming section when the first connector and the second connector are connected to each other, and the cutoff section cuts off the supply of the electricity to the image forming section while the locking mechanism restricts the movement of the operation panel.

2. The image forming apparatus according to claim 1, wherein the operation panel is movable in a specific direction relative to the casing, the specific direction is toward one of the at least one side of the casing, the locking mechanism restricts the movement of the operation panel in the specific direction, the first connector and the second connector are connected to each other, and the cutoff section allows the supply of the electricity to the image forming section when the operation panel moves in the specific direction relative to the casing.

3. The image forming apparatus according to claim 2, wherein the locking mechanism is arranged in a direction opposite to the specific direction relative to the operation panel, and the cutoff section is arranged in the specific direction relative to the operation panel.

4. The image forming apparatus according to claim 1, wherein the locking mechanism includes a first engaging member, the operation panel includes a second engaging member, and the locking mechanism restricts the movement of the operation panel by engaging the first engaging member with the second engaging member.

5. The image forming apparatus according to claim 4, wherein the locking mechanism further includes an urging member, and the urging member urges the first engaging member in a direction in which the first engaging member engages with the second engaging member.

6. The image forming apparatus according to claim 4, wherein the locking mechanism further includes a push button, and when the push button is pushed, the locking mechanism releases engagement of the first engaging member with the second engaging member.

* * * * *